US007270392B2

(12) United States Patent
Mizuno

(10) Patent No.: US 7,270,392 B2
(45) Date of Patent: Sep. 18, 2007

(54) PRINTING APPARATUS, PRINTING METHOD, COMPUTER-READABLE STORAGE MEDIUM, AND PRINTING SYSTEM

(75) Inventor: Hidekazu Mizuno, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 220 days.

(21) Appl. No.: 10/825,609

(22) Filed: Apr. 16, 2004

(65) Prior Publication Data

US 2004/0263553 A1 Dec. 30, 2004

(30) Foreign Application Priority Data

Apr. 17, 2003 (JP) ..... 2003-113350

(51) Int. Cl.
*B41J 29/393* (2006.01)

(52) U.S. Cl. ..... 347/19; 347/15

(58) Field of Classification Search ..... 347/16, 347/15, 19

See application file for complete search history.

(56) References Cited

U.S. PATENT DOCUMENTS 6,270,199 B1 * 8/2001 Kimura et al. ..... 347/65
6,416,151 B1 * 7/2002 Otsuka et al. ..... 347/19
2003/0234847 A1 * 12/2003 Takeoshi et al. ..... 347/102

FOREIGN PATENT DOCUMENTS

| | | | |
|---|---|---|---|
| EP | 1096421 | A2 * | 5/2001 |
| JP | 6-134982 | A | 5/1994 |
| JP | 2001-63019 | A | 3/2001 |
| JP | 2001-83747 | A | 3/2001 |
| JP | 2001-287427 | A | 10/2001 |

* cited by examiner

*Primary Examiner*—Manish S. Shah
*Assistant Examiner*—Laura E. Martin
(74) *Attorney, Agent, or Firm*—Sughrue Mion Pllc.

(57) ABSTRACT

A printing apparatus including a printing head for ejecting ink to a medium to carry out printing thereon, and a side-reversing member for reversing the sides of the medium that is printed by the printing head. A waiting time for drying, before reversing the medium with the side-reversing member, the ink ejected to the medium is set according to an amount of ink ejected by the printing head, and an elapsed-time from when the ink was ejected by the printing head.

12 Claims, 15 Drawing Sheets

| size of dots | amount of ink |
|---|---|
| small dot | 15pl |
| medium dot | 25pl |
| large dot | 35pl |

FIG. 13

PRINTING APPARATUS, PRINTING METHOD, COMPUTER-READABLE STORAGE MEDIUM, AND PRINTING SYSTEM

CROSS-REFERENCE TO RELATED APPLICATIONS

The present application claims priority upon Japanese Patent Application No. 2003-113350 filed Apr. 17, 2003, the contents of which are herein incorporated by reference.

BACKGROUND OF THE INVENTION

1. Field of the Invention

The present invention relates to printing apparatuses, printing methods, computer-readable storage media, and printing systems.

2. Description of the Related Art

Inkjet printers are known as printing apparatuses that can print on various types of media such as paper, cloth, and film. These inkjet printers form dots on a medium to print images thereon by ejecting ink onto the medium.

Some recent inkjet printers are provided with a side-reversing function that allows printing to be performed on both the front and back sides of paper to be printed by reversing (i.e., flipping over) the sides of the paper. In such printers, the paper is reversed with a side-reversing mechanism after the front side of the paper has been printed, and then the back side of the paper is printed. Since both the front and back sides of a medium can be printed on, it is possible to keep the amount of media used small and thus achieve a significant reduction in running costs.

In such printers, however, when the paper is flipped over for printing on the back side thereof after the front side has been printed, there is a possibility that ink will adhere to a path in which the paper is reversed (i.e., to the paper reversing path) and contaminate the path if the ink that has been ejected onto the front side of the paper is not dried sufficiently. In view of such a situation, in conventional printers, a "waiting time" is set in order to dry sufficiently the ink ejected onto the front side of the paper when the paper is reversed after its front side has been printed. This waiting time is set according to, for example, the following methods:

(1) a method of setting the waiting time according to the amount of ink or recording liquid used (refer to, for example, Japanese Patent Application Laid-open Publication No. 2001-63019 or Japanese Patent Application Laid-open Publication No. 2001-83747);

(2) a method of setting the waiting time according to the type of medium to be printed (refer to, for example, Japanese Patent Application Laid-open Publication No. 6-134982); or (3) a method of setting the waiting time according to both the amount of ink used and the type of ink or paper (refer to, for example, Japanese Patent Application Laid-open Publication No. 2001-287427).

The methods (1) through (3) described above, however, have the following drawbacks. That is, in those methods, even though the ink usage amount, the type of ink, and/or the type of medium are taken into consideration in setting the waiting time, the elapsed-time after the ink has been ejected is not. Therefore, it is difficult to say that the waiting time is set accurately in those methods. More specifically, since the amount of time from the start to the end of printing is considerably long for printing one sheet of medium, the sections that have been printed earlier will become dry while printing is being carried out, and thus, there will be a significant difference in drying conditions between the sections printed earlier and sections that are printed later. Regarding this difference in drying conditions, the waiting time will not be set appropriately if the elapsed-time is not taken into consideration, and thus, drawbacks such as that the waiting time becomes long arises.

SUMMARY OF THE INVENTION

The present invention has been made in view of the above and other problems, and an object thereof is to set appropriately a waiting time in order to dry the ink on the front side of a medium when the medium is reversed after its front side has been printed, and thereby shorten the waiting time.

An aspect of the present invention a printing apparatus comprising: a printing head for ejecting ink to a medium to carry out printing thereon; and a side-reversing member for reversing the sides of the medium that is printed by the printing head, wherein a waiting time for drying, before reversing the medium with the side-reversing member, the ink ejected to the medium is set according to an amount of ink ejected by the printing head, and an elapsed-time from when the ink was ejected by the printing head.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 13 is a diagram showing an example of how data is formed for the dot size and the ink ejection amount;

DETAILED DESCRIPTION OF THE INVENTION

Figure 1:
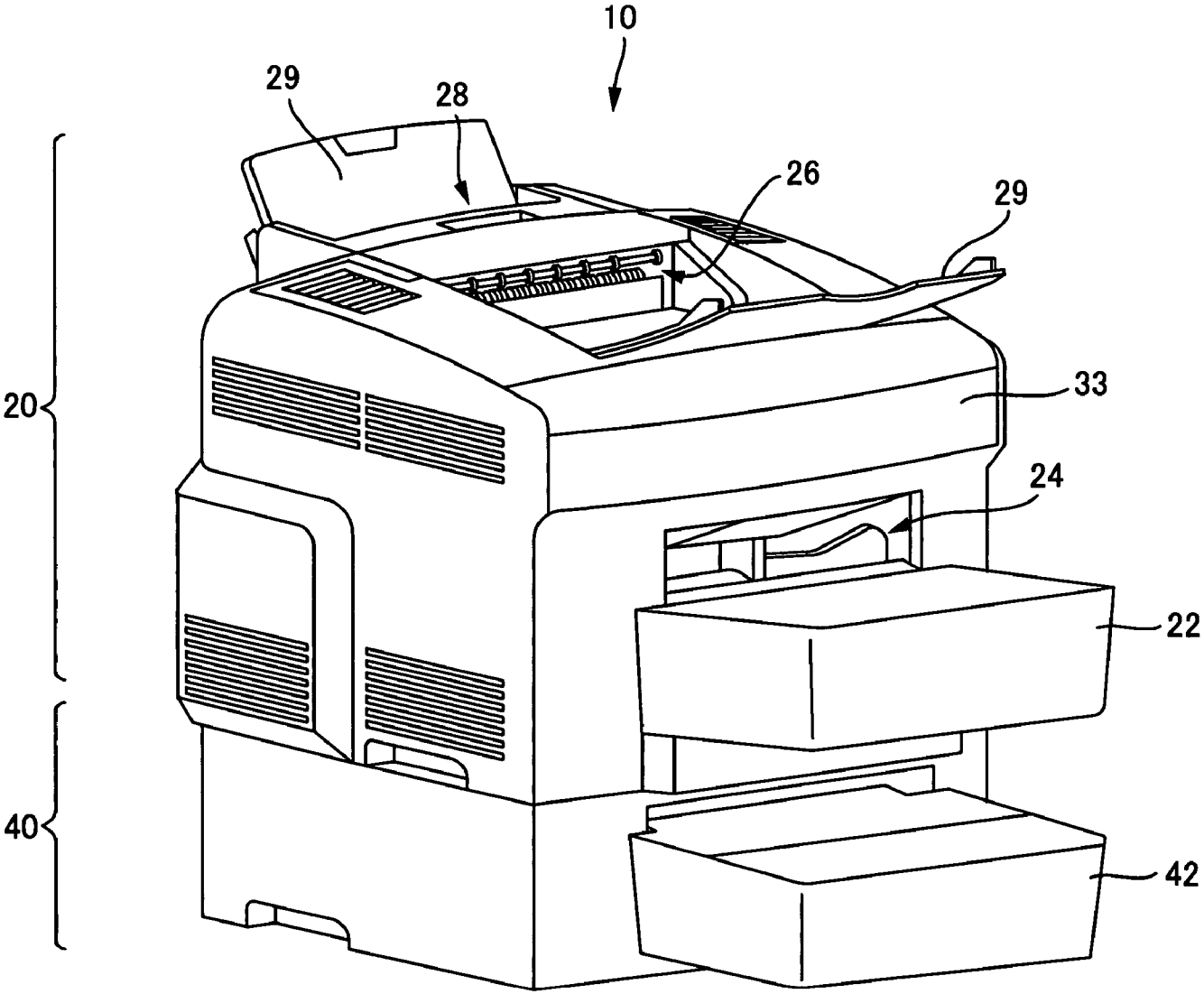
FIG. 1 is a perspective view showing an embodiment of a printing apparatus.

At least the following matters will be made clear by the explanation in the present specification and the description of the accompanying drawings.

An aspect of the present invention is a printing apparatus comprising:

a printing head for ejecting ink to a medium to carry out printing thereon; and a side-reversing member for reversing the sides of the medium that is printed by the printing head, wherein a waiting time for drying, before reversing the medium with the side-reversing member, the ink ejected to the medium is set according to an amount of ink ejected by the printing head, and an elapsed-time from when the ink was ejected by the printing head.

According to this printing apparatus, it is possible to set an appropriate waiting time for drying the ink because the waiting time is set according to the amount of ink ejected by the printing head, and the elapsed-time from when the ink was ejected by the printing head. Therefore, it is possible to shorten the waiting time and achieve increase in printing speed.

The printing apparatus may further comprise a carrying member for carrying the medium, and the printing head may perform a printing action during intervals between carrying actions of the carrying member. It is possible to set an appropriate waiting time even with this printing apparatus in which printing is performed during intervals between carrying actions of the carrying member. Therefore, it is possible to shorten the waiting time and achieve increase in printing speed.

Further, in the printing apparatus, the waiting time may be set according to an amount of ink ejected by the printing head during an interval between the carrying actions of the carrying member, and an elapsed-time from the printing action performed by the printing head during the interval between the carrying actions. The waiting time will be appropriate when it is set in this way, and therefore, it is possible to shorten the waiting time and achieve increase in printing speed.

Further, in the printing apparatus, the amount of ink ejected by the printing head may be calculated based on a number of times the ink is ejected by the printing head, and an amount of the ink ejected by the printing head per one ejection action. In this way, it is possible to calculate the ink ejection amount easily.

Further, in the printing apparatus, the waiting time may differ according to the type of the ink ejected by the printing head, the type of the medium that is printed by the printing head, surrounding temperature, or surrounding humidity. By setting the waiting time so that it differs according to the type or color of the ink, the type of medium, surrounding temperature, or surrounding humidity, it is possible to set an appropriate waiting time that suits each condition, and therefore, it is possible to shorten the waiting time.

Another printing apparatus comprises:

a printing head for ejecting ink to a medium to carry out printing thereon;

a side-reversing member for reversing the sides of the medium that is printed by the printing head; and a carrying member for carrying the medium, wherein:

the printing head performs a printing action during intervals between carrying actions of the carrying member;

a waiting time for drying, before reversing the medium with the side-reversing member, the ink ejected to the medium is set according to an amount of ink ejected by the printing head during an interval between the carrying actions of the carrying member, and an elapsed-time from the printing action performed by the printing head during the interval between the carrying actions; and the amount of ink ejected by the printing head is calculated based on a number of times the ink is ejected by the printing head, and an amount of the ink ejected by the printing head per one ejection action.

Another aspect of the present invention is a computer-readable storage medium having recorded thereon a program executed by a printing apparatus that includes a printing head for ejecting ink to a medium to carry out printing thereon, and a side-reversing member for reversing the sides of the medium that is printed by the printing head. The program achieves the step of setting a waiting time for drying, before reversing the medium with the side-reversing member, the ink ejected to the medium according to an amount of ink ejected by the printing head, and an elapsed-time from when the ink was ejected by the printing head.

Another aspect of the present invention is a printing method comprising the steps of:

ejecting ink to a medium to carry out printing thereon;

waiting in order to dry the ink ejected to the medium, a waiting time for this waiting step being set according to an amount of the ink ejected, and an elapsed-time from when the ink was ejected; and reversing the sides of the medium after waiting for the waiting time.

Another aspect of the present invention is a printing system comprising:

a computer; and a printing apparatus that is connectable to the computer and that includes a printing head for ejecting ink to a medium to carry out printing thereon, and a side-reversing member for reversing the sides of the medium that is printed by the printing head, wherein a waiting time for drying, before reversing the medium with the side-reversing member, the ink ejected to the medium is set according to an amount of ink ejected by the printing head, and an elapsed-time from when the ink was ejected by the printing head.

===Overview of Printing Apparatus===

Figure 2:
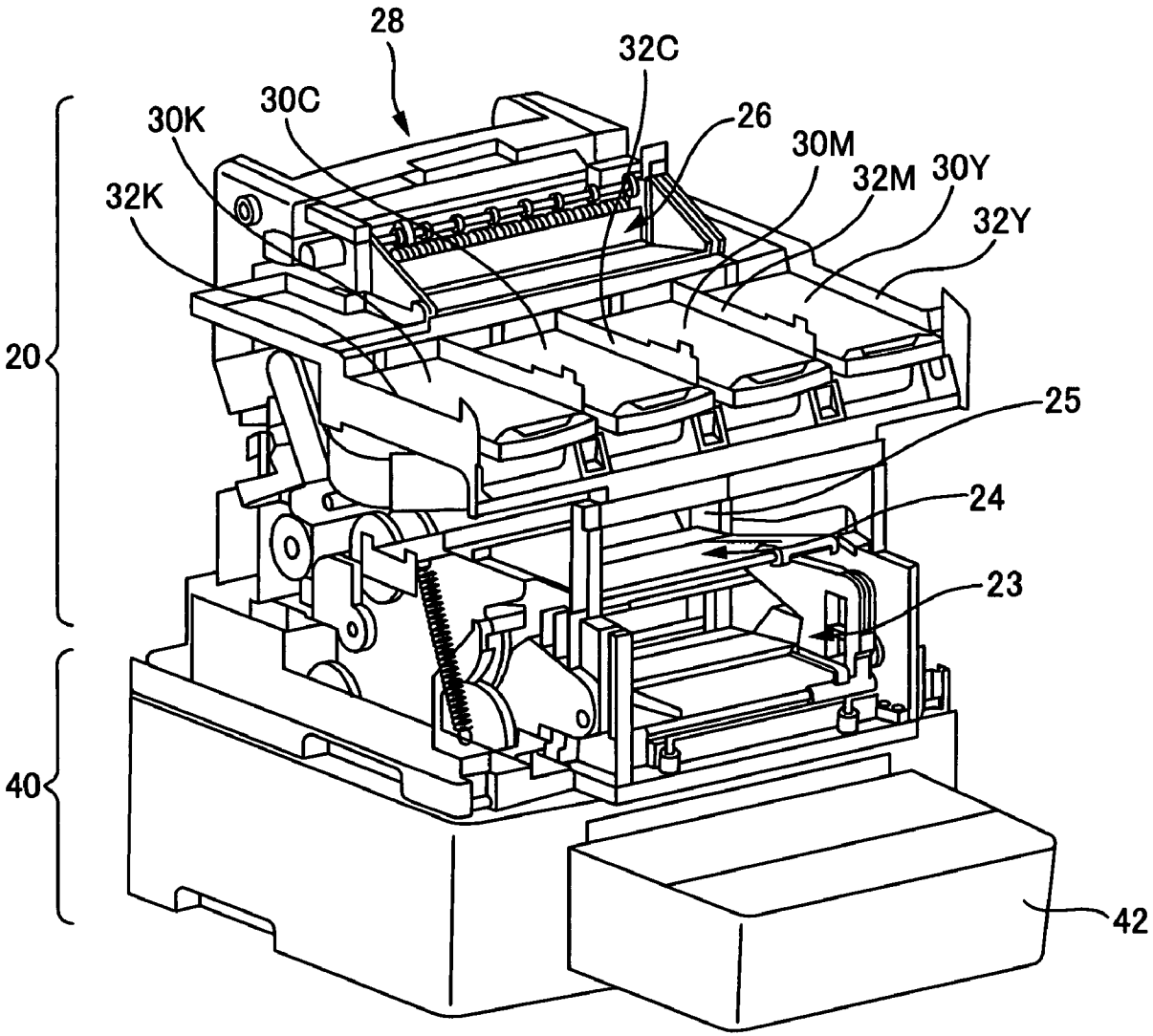
FIG. 2 is a perspective view showing an internal configuration of the printing apparatus.
Figure 3:
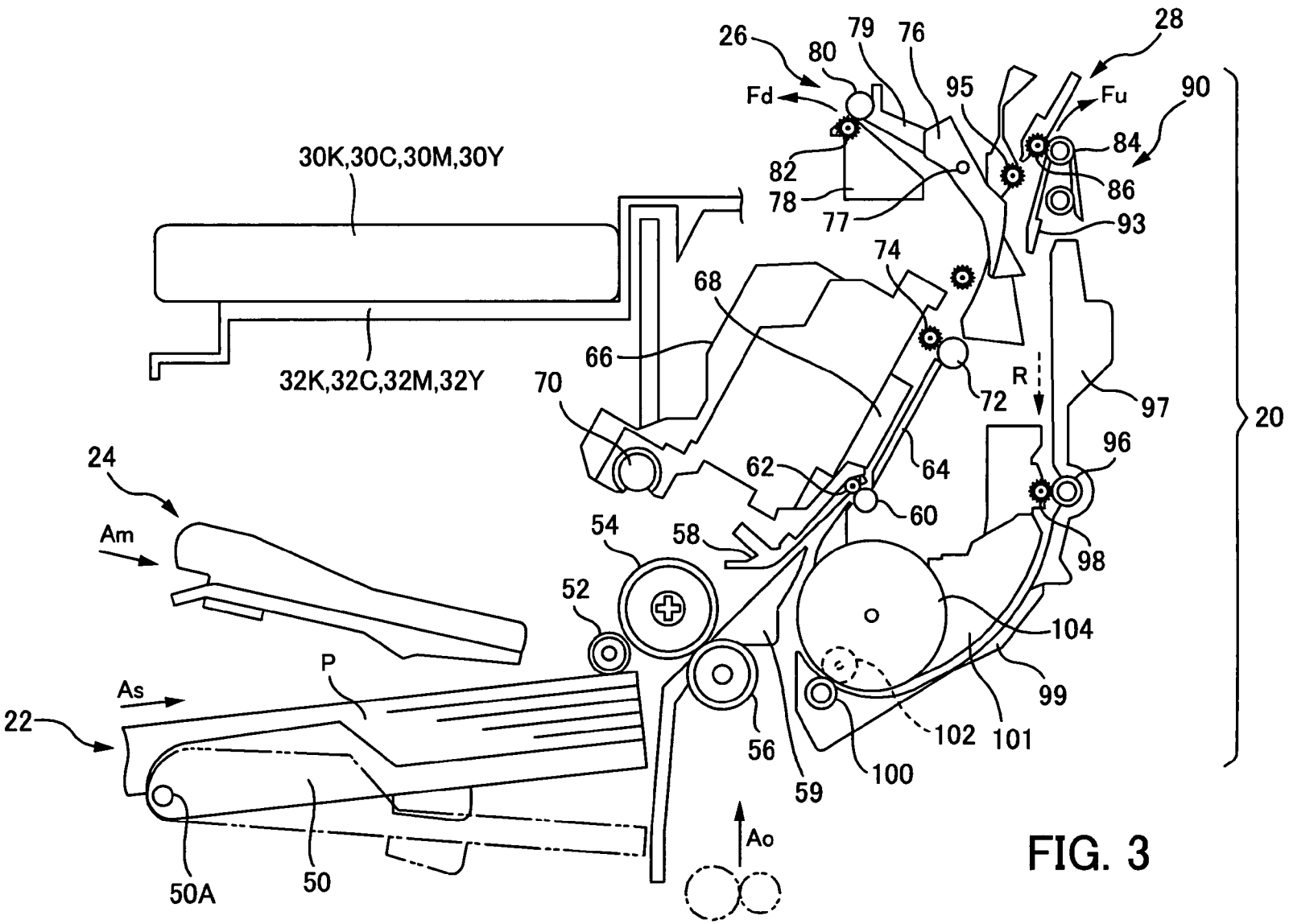
FIG. 3 is a cross-sectional view showing a medium carrying mechanism of the printing apparatus.
Figure 4:
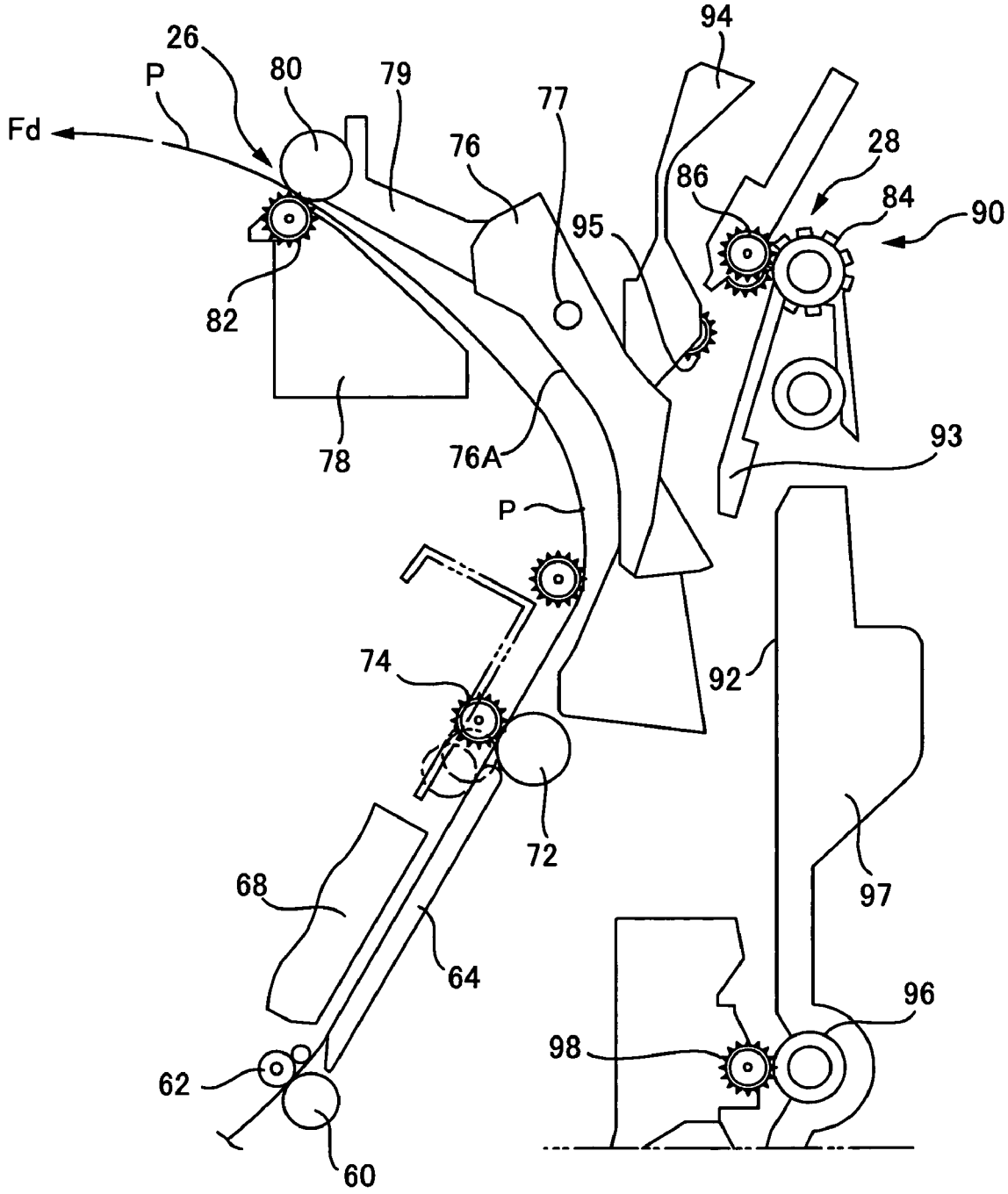
FIG. 4 is an explanatory diagram illustrating a state of operation for face-down paper discharge.
Figure 5:
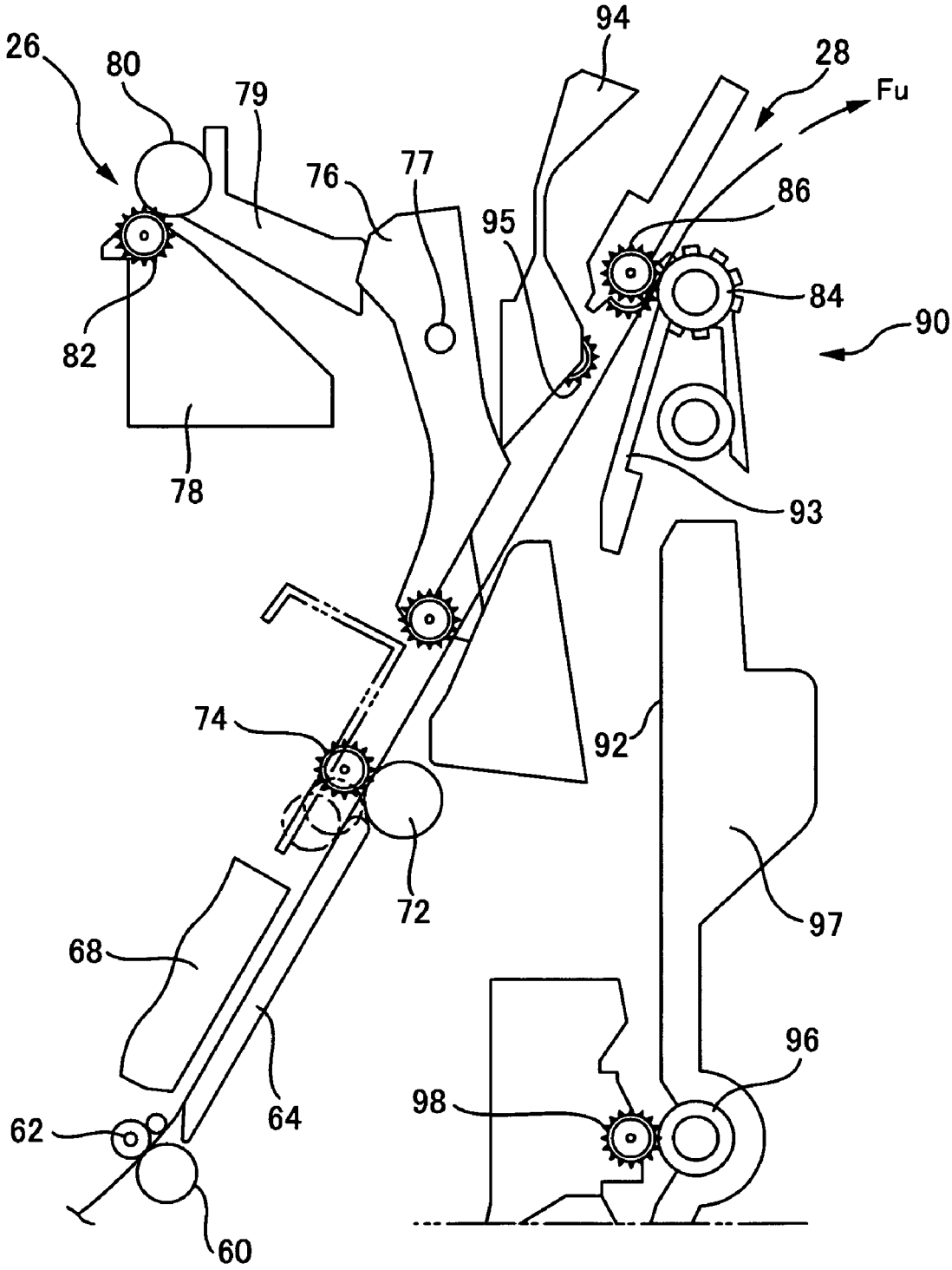
FIG. 5 is an explanatory diagram illustrating a state of operation for face-up paper discharge.
Figure 6:
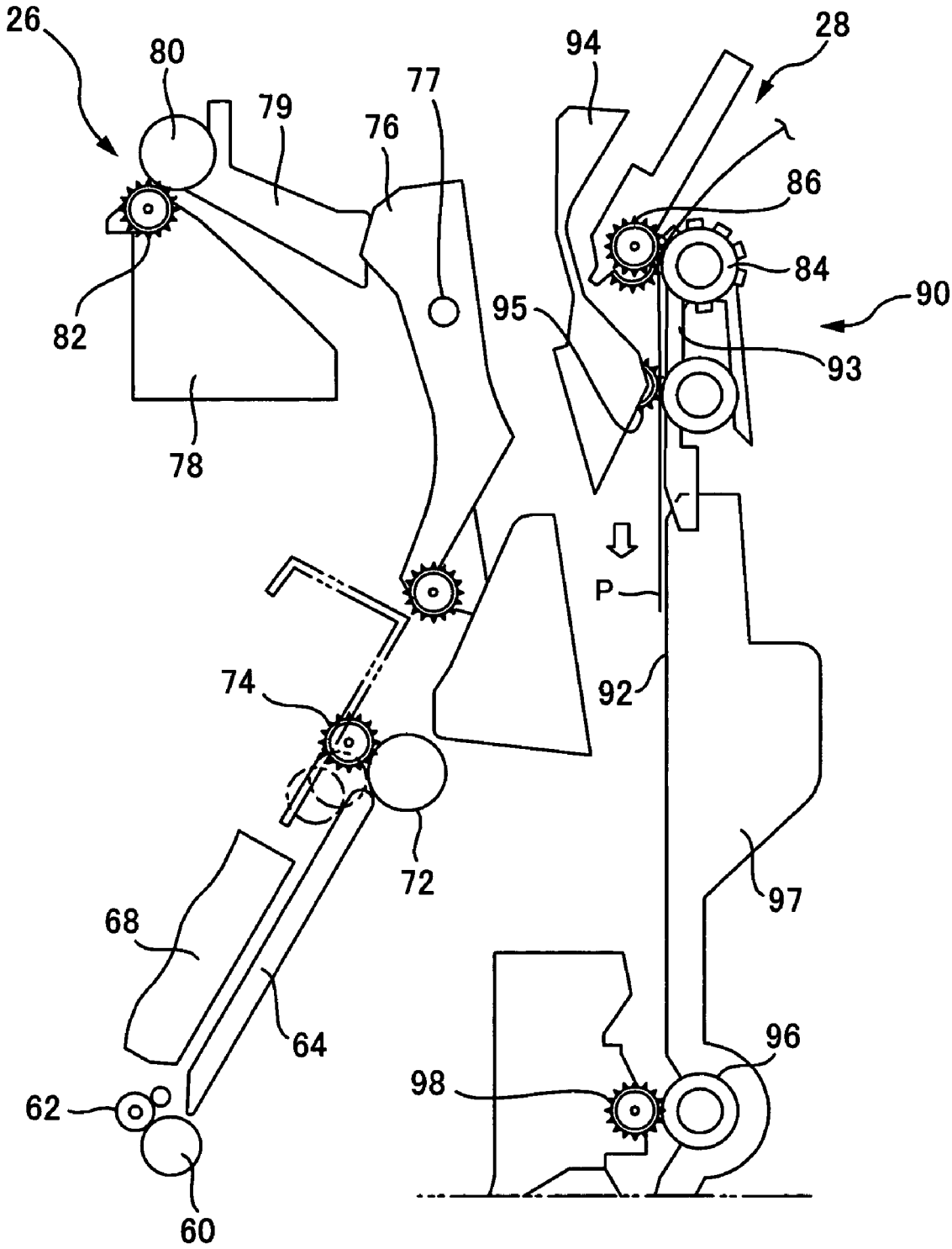
FIG. 6 is an explanatory diagram illustrating a state of operation for when the sides of the medium are reversed.
Figure 7:
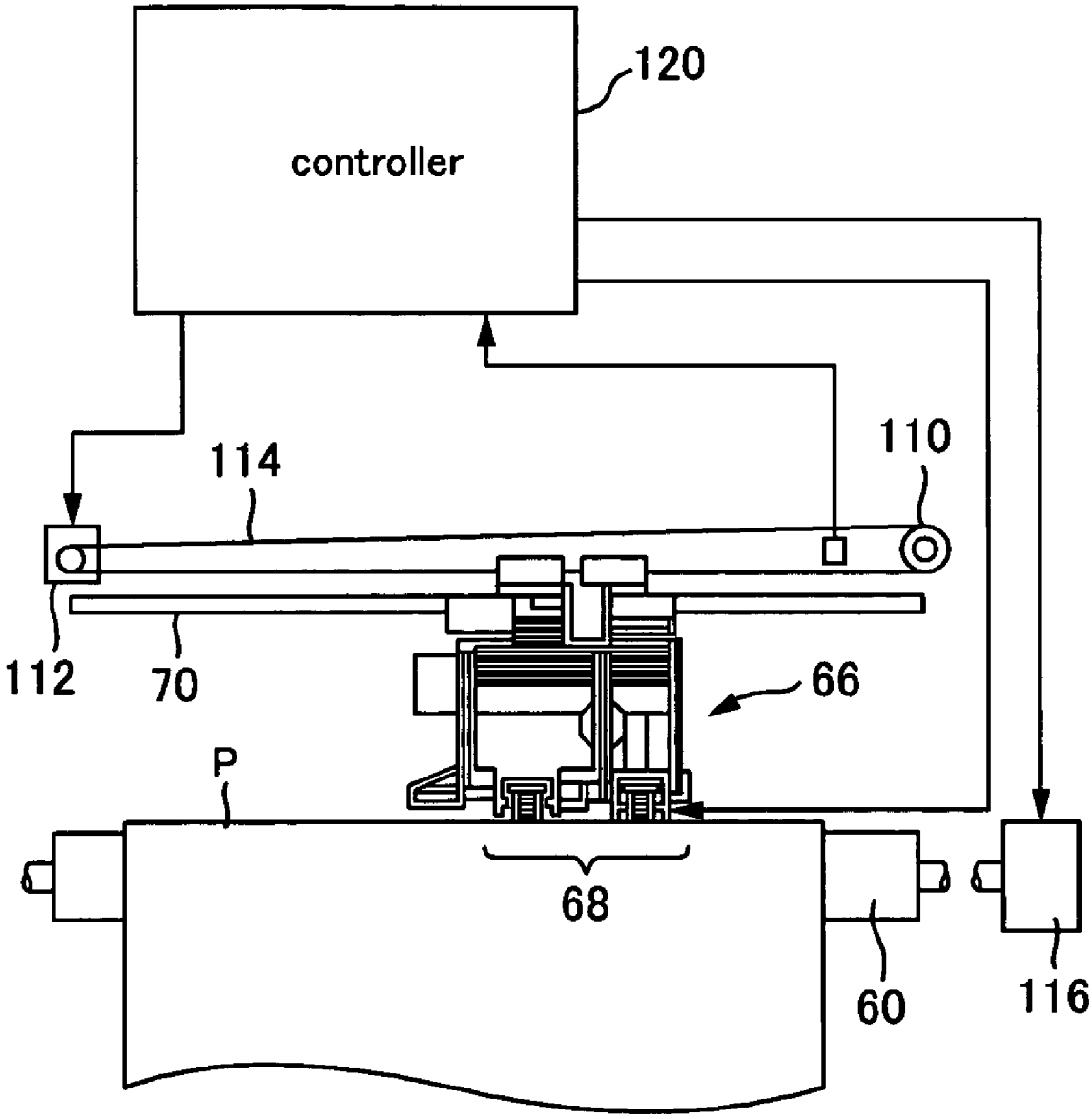
FIG. 7 is a diagram showing the periphery of a print head of the printing apparatus.
Figure 8:
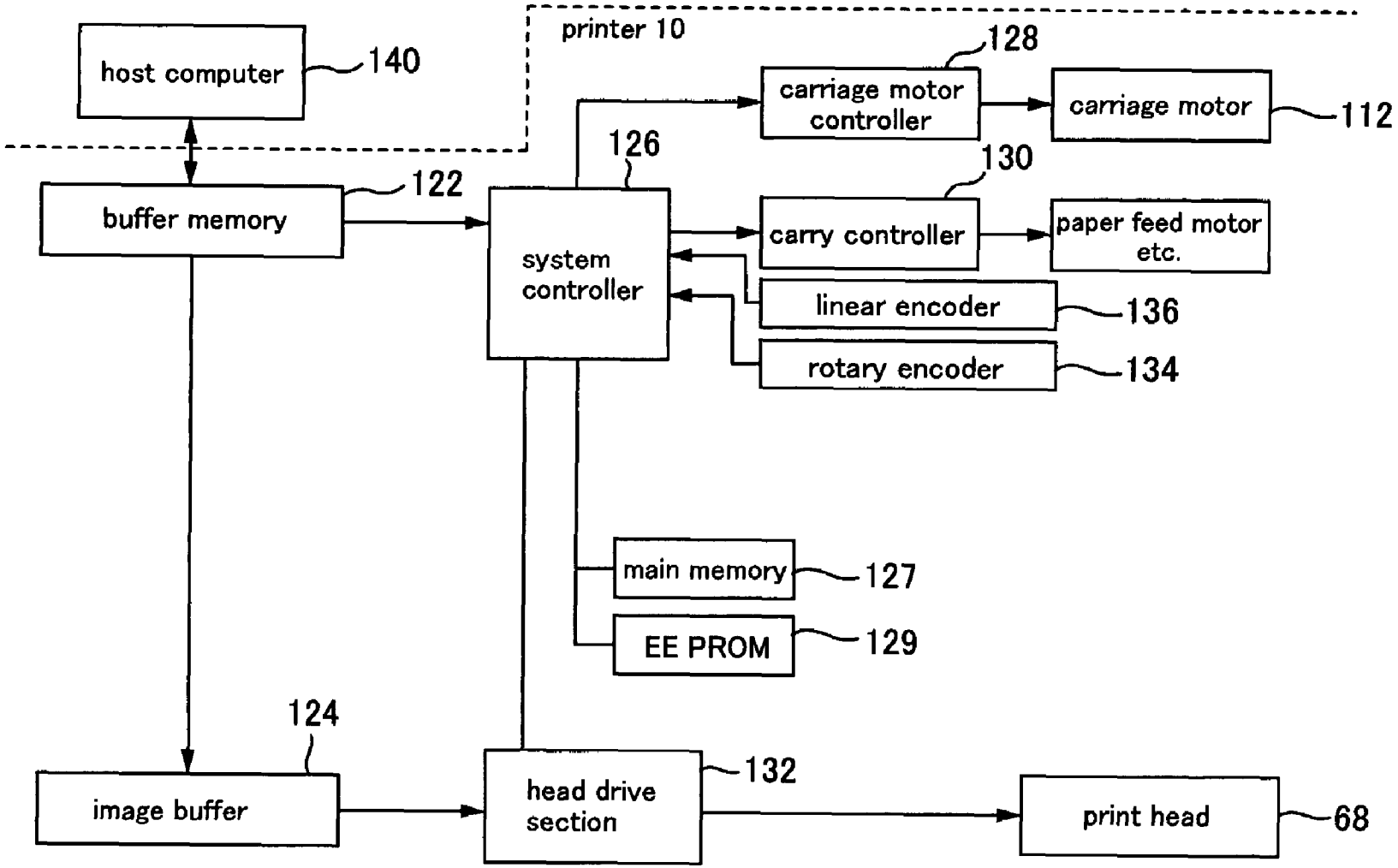
FIG. 8 is a system configuration diagram of the printing apparatus.

An overview of a printing apparatus according to the present invention is described below, taking an inkjet printer as an example. FIG. 1 through FIG. 8 are for illustrating an overview of the inkjet printer. FIG. 1 is a perspective view showing an external appearance of the inkjet printer. FIG. 2 is a perspective view showing the inside of the printer. FIG. 3 is a cross-sectional view showing a carrying section. FIG. 4 and FIG. 5 are diagrams for illustrating paper discharging actions. FIG. 6 is a diagram for illustrating paper reversing actions. FIG. 7 is a diagram for illustrating a carriage and a drive mechanism therefor. FIG. 8 is a block configuration diagram showing a system configuration of the printer.

As shown in FIG. 1, the inkjet printer 10 includes a printer body 20 and a paper supplying unit 40 that is attached to the bottom section of the printer body 20.

The printer body 20 includes a paper supplying cassette 22, a manual feed tray 24, and two paper discharging sections 26 and 28. The paper supplying cassette 22 is attachable to and detachable from the bottom section of the printer body 20 and is configured such that a plurality of media such as paper to be printed are set in it. The manual feed tray 24 is provided above the paper supplying cassette 22 and is configured such that a medium such as paper can easily be set from the outside and can be used for printing.

The two paper discharging sections 26 and 28 are provide at the upper section of the printer body 20. In the present embodiment, a face-down paper discharging section 26 and a face-up paper discharging section 28 are provided as these paper discharging sections. At the face-down paper discharging section 26, the paper is discharged with the printed side facing downwards.

On the other hand, at the face-up paper discharging section 28, the paper is discharged with the printed side facing upwards. The face-down paper discharging section 26 is provided with a cover 27 that opens/closes the face-down paper discharging section 26. The cover 27 is opened when paper is discharged from the face-down paper discharging section 26. The opened cover 27 can be used as a stacker on which the paper discharged from the face-down paper discharging section 26 can be stacked. On the other hand, the face-up paper discharging section 28 is provided with a stacker 29 dedicated for paper discharged from the face-up paper discharging section 28 to be stacked thereon.

On the other hand, to the paper supplying unit 40 are set a plurality of pieces of paper to be printed by the printer body 20. The paper supplying unit 40 is provided with a paper supplying cassette 42 to which a plurality of pieces of paper can be set.

The pieces of paper set to the paper supplying cassettes 22 and 42 and the manual feed tray are supplied into the printer body 20 and printed while being carried upwards inside the printer body 20. The printed paper is carried either to the face-down paper discharging section 26 or the face-up paper discharging section 28 and is discharged outside through either one of the two paper discharging sections 26 and 28.

Next, the inner configuration of the inkjet printer 10 will be described. FIG. 2 shows the inside of the printer when the outer housing of the printer body 20 is taken off. As shown in FIG. 2, in the upper section of the printer body 20, there are provided ink cartridges 30K, 30C, 30M, and 30Y and cartridge attaching sections 32K, 32C, 32M, and 32Y to which the ink cartridges 30K, 30C, 30M, and 30Y are attached. These ink cartridges 30K, 30C, 30M, and 30Y are aligned sideways at an upper section of the manual feed tray 24 (and at a front section of the face-down paper discharging section 26. Each ink cartridge 30K, 30C, 30M, and 30Y contains ink inside. Here, ink of four types—black (K), cyan (C), magenta (M), and yellow (Y)—are contained in the respective cartridges. The ink cartridges 30K, 30C, 30M, and 30Y can easily be replaced from the outside by taking off an ink cartridge cover 33 shown in FIG. 1, without taking off the whole outer housing of the printer body 20.

It should be noted that in the present embodiment, ink of four types—black (K), cyan (C), magenta (M), and yellow (Y)—are provided. The present invention, however, is not limited thereto, and it is possible to use other types of inks such as light cyan (pale cyan, LC), light magenta (pale magenta, LM), and dark yellow (dim yellow, DY) in addition to the ink of the four colors.

In the lower section of the printer body 20, there is provided a paper supplying cassette attaching section 23 to which the paper supplying cassette 22 is attached. Further, above the attaching section 23 is provided a paper supplying opening 25 for the manual feed tray 24.

===Carrying Mechanism===

Next, the carrying mechanism of the inkjet printer 10 will be described in detail. FIG. 3 shows the carrying mechanism of the inkjet printer 10. The paper supplying cassette 22, which is attached to the lower section of the printer body 20, is provided with a hopper 50 for lifting up the paper P that has been set. The hopper 50 can rotate (pivot) about a rotating shaft 50A. When paper is to be supplied, the hopper 50 rotates about the rotating shaft 50A as shown in FIG. 3 to lift the paper P up. The paper P that has been lifted up by the hopper 50 comes into abutment against a pickup roller 52 arranged above the hopper 50.

By being driven to rotate, the pickup roller 52 takes out the paper P one by one from the uppermost sheet, and feeds the sheet of paper upwards. The paper P fed upwards is pinched between a paper supplying roller 54 and a reverse roller 56 and is fed further upwards by these two rollers 54 and 56. Then, the paper P travels between guide members 58 and 59 and reaches a first carry drive roller 60. The first carry drive roller 60 pinches the fed paper P between it and a first carry driven roller 62, and feeds the paper P successively onto a platen 64.

A carriage 66 is arranged in opposition to the platen 64 with a space between it and the platen 64. The carriage 66 has a print head 68 that is provided with a plurality of nozzles (not shown) for ejecting ink. The carriage 66 is movable along a guide shaft 70 in the direction intersecting with the direction in which the paper is carried (i.e., the paper carrying direction), that is, in the direction perpendicular to the paper face of FIG. 3 in the present embodiment. The carriage 66 ejects ink from the print head 68 towards the paper P that has been fed onto the platen 64 while moving relatively with respect to the paper P along the guide shaft 70 to carry out printing on the paper P. It should be noted that in the present embodiment, the print head 68 serves as the printing head of the present invention.

Further, tubes (not shown) are provided between the carriage 66 and the ink cartridges 30K, 30C, 30M, and 30Y for supplying ink from each of the ink cartridges 30K, 30C, 30M, and 30Y to each of the nozzles for each color of the print head 68 of the carriage 66 in such a manner that ink supply to the nozzles of the print head 68 is not interrupted even when the carriage 66 moves along the guide shaft 70.

The printed paper P is successively fed upwards, i.e., towards the paper-discharging side by the first carry drive roller 60 and the first carry driven roller 62. A second carry drive roller 72 and a second carry driven roller 74 are arranged at the paper-discharging side, and the paper P that has been fed to the paper-discharging side is pinched between the second carry drive roller 72 and the second carry driven roller 74 and fed further upwards thereby.

A switching member 76 is arranged above the second carry drive roller 72 and the second carry driven roller 74. The switching member 76 can rotate (swing) about a rotating shaft 77 to change the traveling direction of the paper P that has been fed, so that the destination towards which the paper P travels is selectively switched between either the face-down paper discharging section 26 or the face-up paper discharging section 28.

FIG. 4 shows how the paper P is fed to the face-down paper discharging section 26. When the paper P is fed to the face-down paper discharging section 26, the switching member 76 rotates to the side of the face-down paper discharging section 26, as shown in FIG. 4. The paper P is guided along a guide section 76A formed in the switching member 76, travels between guide members 78 and 79, and is fed to the face-down paper discharging section 26. A first paper-discharging drive roller 80 and a first paper-discharging driven roller 82 are provided at the face-down paper discharging section 26. The paper P that has been fed is pinched between the first paper-discharging drive roller 80 and the first paper-discharging driven roller 82, and is discharged outside the printer body 20.

FIG. 5 shows how the paper P is fed to the face-up paper discharging section 28. When the paper P is fed to the face-up paper discharging section 28, the switching member 76 rotates to the side of the face-up paper discharging section 28, as shown in FIG. 5. The paper P travels straight forward, passes beneath the switching member 76, and is fed to the face-up paper discharging section 28. A second paper-discharging drive roller 84 and a second paper-discharging driven roller 86 are provided at the face-up paper discharging section 28. The paper P that has been fed is pinched between the second paper-discharging drive roller 84 and the second paper-discharging driven roller 86, and is discharged outside the printer body 20.

===Paper Reversing Mechanism===

In addition to the carrying mechanism described above, the inkjet printer according to the present embodiment is provided with a paper reversing mechanism 90 for reversing (i.e., flipping over) the paper P to print on the back side of the paper. The paper reversing mechanism 90 can flip the printed paper P over and feed the paper back towards the paper-supplying side so that the back side is printed by the print head 68. The paper reversing mechanism 90 of the inkjet printer 10 according to the present embodiment will be described in detail below.

The paper reversing mechanism 90 is for taking in the paper P which has once been fed to the face-up paper discharging section 28, for reversing the sides of the paper P that has been taken in, and for feeding the paper P back towards the paper-supplying side. As shown in FIG. 3 through FIG. 5, the paper reversing mechanism 90 includes a guide member 94 for guiding the paper P that has been fed to the face-up paper discharging section 28 to a paper reversing path 92, a third carry drive roller 96 and a third carry driven roller 98 for carrying the paper P that has been fed into the paper reversing path 92, and a reversing drive roller 100 and a reversing driven roller 102 for feeding the paper P that has been carried by the third carry drive roller 96 and the third carry driven roller 98 to the paper-supplying side, i.e., in between the first carry drive roller 60 and the first carry driven roller 62.

FIG. 6 is a diagram showing how the paper P is reversed with this paper reversing mechanism 90. In order to reverse the sides of the paper P with the paper reversing mechanism 90, the paper P is first fed to the face-up paper discharging section 28 and is discharged out from the face-up paper discharging section 28 with the second paper-discharging drive roller 84 and the second paper-discharging driven roller 86. When the amount for which the paper is discharged outside reaches a predetermined amount, the second paper-discharging drive roller 84 is rotated backwards so that the paper P that has been discharged outside is brought back into the printer body 20.

The paper P that has been brought back in is guided into the paper reversing path 92 by the guide member 94. The guide member 94 can rotate (swing) about a rotating shaft (not shown). When the paper P is fed from the platen 64 to the face-up paper discharging section 28, the guide member 94 is retracted so that it does not interfere with the carrying of the paper P, as shown in FIG. 5. When the paper P is fed into the paper reversing path 92, however, the guide member 94 protrudes towards the paper P, as shown in FIG. 6, and presses against the paper P with its guide roller 95 to pinch the paper P between the guide roller 95 and a guide member 93 and guide the paper P so that it is fed into the paper reversing path 92.

The paper P that has been led into the paper reversing path 92 in this way is fed in between the third carry drive roller 96 and the third carry driven roller 98, is pinched between these two rollers 96 and 98, and is further carried in the paper reversing path 92 along a guide member 97 and through a space between guide members 99 and 101 (see FIG. 3). The paper P is then pinched between the reversing drive roller 100 and the reversing driven roller 102 (see FIG. 3) and is fed in between the first carry drive roller 60 and the first carry driven roller 62 while being guided by a guide roller 104 and the guide members 59, 99, and 105 (see FIG. 3). In this way, the paper P is reversed by passing through the paper reversing path 92 and is fed back to the paper-supplying side.

The paper P that has been fed back to the paper-supplying side, that is, in between the first carry drive roller 60 and the first carry driven roller 62 is then fed onto the platen 64 again by these rollers 60 and 62. At this time, at the platen 64, the back side of the paper P is in opposition to the print head 68 and thus the print head 68 prints on the back side of the paper P.

===Carriage and Drive Mechanism Therefor===

FIG. 7 illustrates the carriage 66 and the drive mechanism therefor. The carriage 66 is supported by the guide shaft 70 that is provided in the direction intersecting with the carrying direction of the paper P, and is relatively movable along the guide shaft 70. The carriage 66 is connected to a drive belt 114 that is extended between a pulley 110 and a carriage motor 112 (referred to also as "CR motor" below). When the carriage motor 112 is driven, the carriage 66 is moved along the guide shaft 70 by the drive belt 114.

The print head 68 provided on the carriage 66 moves, along with the movement of the carriage 66, while keeping a space between it and the paper P, and ejects ink from the nozzles of each color towards the paper P, thereby carrying out printing on the paper P. This printing action is carried out during intervals between the intermittent carrying action of the paper P performed by the first carry drive roller 60. The first carry drive roller 60 is driven by a paper feed motor 116 (referred to also as "PF motor" below).

Further, the carriage motor 112, the paper feed motor 116, and the print head 68 are driven and controlled by a controller 120.

===Overview of Controller 120===

The controller 120 will be described in detail below. FIG. 8 is a block diagram showing a configuration of the controller 120.

The controller 120 includes a buffer memory 122, an image buffer 124, a system controller 126, a main memory 127, and an EEPROM 129. The buffer memory 122 receives various types of data, such as print data, that are sent from a host computer 140 and temporarily stores those data. The image buffer 124 obtains the received print data from the buffer memory 122 and stores the data. The main memory 127 is structured of, for example, a ROM and/or a RAM.

The system controller 126 is structured of, for example, a CPU and/or an ASIC. It obtains a control program from the main memory 127 and executes overall control of the printer body 20 according to the control program. The system controller 126 of the present embodiment is connected to a carriage motor controller 128, a carry controller 130, a head drive section 132, a rotary encoder 134, and a linear encoder 136. The carriage motor controller 128 drives and controls the rotating direction, the number of times of rotations, the torque, etc. of the carriage motor 112. The head drive section 132 drives and controls the print head 68.

The carry controller 130 drives and controls the drive motors, such as the paper feed motor 116 for driving the first carry drive roller 60, that rotationally drive the drive rollers arranged in the carrying system, such as the second carry drive roller 72, the first paper-discharging drive roller 80, the second paper-discharging drive roller 84, and the pickup roller 52. The carry controller 130 also controls the switching member 76 that switches the paper discharging direction of the paper P, the guide member 94 that guides the paper P into the paper reversing path, and drive motors that rotationally drive the third carry drive roller 96 and the reversing drive roller 100 of the paper reversing mechanism 90.

The print data sent from the host computer 140 is temporarily stored in the buffer memory 122. The system controller 126 reads out necessary information from the print data stored in the buffer memory 122. Based on the information that has been read out and with reference to the output from the linear encoder 136 and the rotary encoder 134, the system controller 126 controls the carriage motor controller 128, the carry controller 130, and the head drive section 132 according to the control program.

The image buffer 124 stores print data for the plurality of color components that have been received by the buffer memory 122. The head drive section 132 obtains the print data for each color component from the image buffer 124 according to control signals from the system controller 126, and drives and controls the nozzles for each color, which are provided in the print head 68, based on the print data.

===Ejecting Mechanism of the Print Head===

Figure 9:
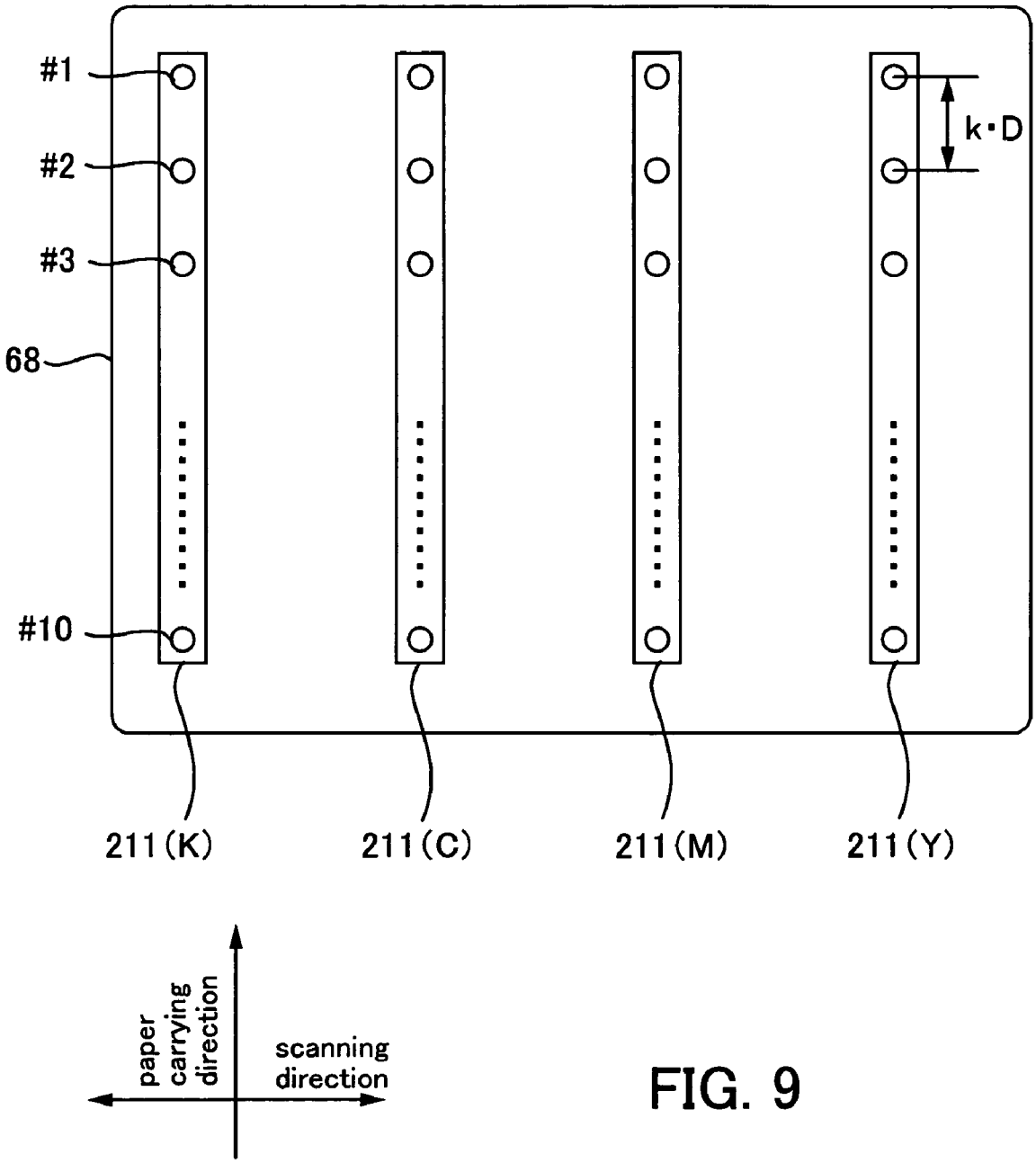
FIG. 9 is a plan view showing nozzles of the print head.

FIG. 9 is a diagram showing an arrangement of ink ejection nozzles provided in the bottom surface of the print head 68. As shown in FIG. 9, nozzle rows 211, each including a plurality of nozzles #1 through #10, are provided for each of the colors black (K), cyan (C), magenta (M), and yellow (Y) in the bottom surface of the print head 68. The nozzles #1 through #10 are arranged in a straight line in the carrying direction of the paper P. The nozzle rows 211 are arranged in parallel to each other with a space provided between each row in the moving direction (scanning direction) of the print head 68. Each nozzle #1 through #10 is provided with a piezoelectric element (not shown) which serves as a drive element for causing the nozzle to eject ink droplets.

When a voltage having a predetermined time width is applied between electrodes provided on both ends of the piezoelectric element, the element expands according to the amount of time for which the voltage is applied, thereby deforming the side walls of the passage through which the ink flows. Accordingly, the volume of the ink flow passage decreases according to the expansion of the piezoelectric element, and an amount of ink equal to the amount of volume decrease is ejected, as an ink droplet, from each nozzle #1 through #10 for each color.

Figure 10:
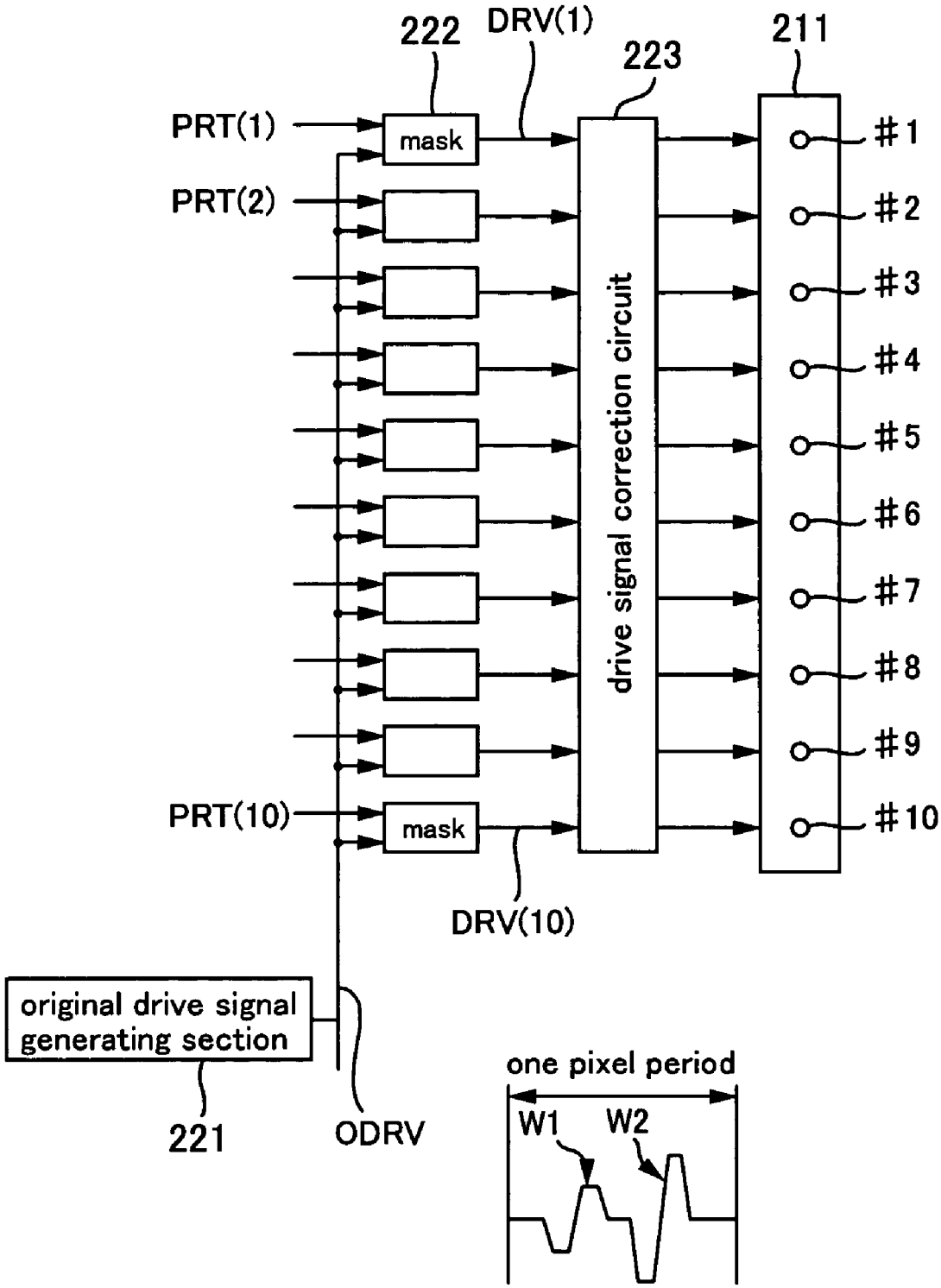
FIG. 10 is a circuit diagram showing an embodiment of a nozzle drive circuit.

FIG. 10 shows a drive circuit for the nozzles #1 through #10. As shown in the figure, the drive circuit includes an original drive signal generating section 221, a plurality of mask circuits 222, and a drive signal correction circuit 223. The original drive signal generating section 221 generates original signals ODRV that are used in common among the nozzles #1 through #n. The original signal ODRV is a signal that includes two pulses—a first pulse W1 and a second pulse W2—during the main scan period for one pixel (i.e., during the time in which the carriage 66 passes across a distance for one pixel), as shown in the lower section of the figure. The original signal ODRV that has been generated by the original drive signal generating section 221 is output to each of the mask circuits 222.

The mask circuit 222 is provided for each of the plurality of piezoelectric elements that drives each of the nozzles #1 through #n of the print head 68. The original signal ODRV is input from the original drive signal generating section 221 to each mask circuit 222, and also, print signals PRT(i) are input to each mask circuit 222. The print signal PRT(i) is pixel data corresponding to each pixel and is a binary signal containing two-bit information for one pixel. Based on the two-bit information of the print signal PRT(i), the mask circuit 222 either lets both of the first and second pulses W1 and W2 of the original signal ODRV pass through, lets only one of the pulses pass through, or cuts off both pulses. More specifically, if the print signal PRT(i) is "11", then the mask circuit 222 lets both of the first and second pulses W1 and W2 of the original signal ODRV pass through. On the other hand, if the print signal PRT(i) is "10", then the mask circuit 222 lets only the first pulse W1 pass through and cuts off the second pulse W2, whereas if the print signal PRT(i) is "01", then the mask circuit 222 lets only the second pulse W2 pass through and cuts off the first pulse W1. Furthermore, if the print signal PRT(i) is "00", then the mask circuit 222 cuts off both of the first and second pulses W1 and W2. The original signal ODRV that has passed the mask circuit 222 is input to the drive signal correction circuit 223 as a drive signal DRV.

The drive signal correction circuit 223 carries out correction by shifting the timing of the waveform of the drive signal DRV received from the mask circuit 222. The drive signal DRV that has been corrected by the drive signal correction circuit 223 is output to the piezoelectric element of each nozzle #1 through #10. The piezoelectric element of each nozzle #1 through #10 is driven based on the drive signal DRV from the drive signal correction circuit 223 and causes the corresponding nozzle to eject ink.

In the inkjet printer 10 according to the present embodiment, a drive circuit for the nozzles #1 through #10 is provided for each nozzle row 211, that is, for each of the nozzle rows 211(K), 211(C), 211(M), and 211(Y) for the respective colors of black (K), cyan (C), magenta (M), and yellow (Y), and thus, the piezoelectric elements are driven separately in units of nozzle rows.

===Print Mode===

The inkjet printer 10 according to the present embodiment includes at least two print modes: the one-side print mode and the duplex print mode. The one-side print mode allows printing to be carried out only on either the front side or the back side of paper P, that is, allows printing only on one side.

Figure 11:
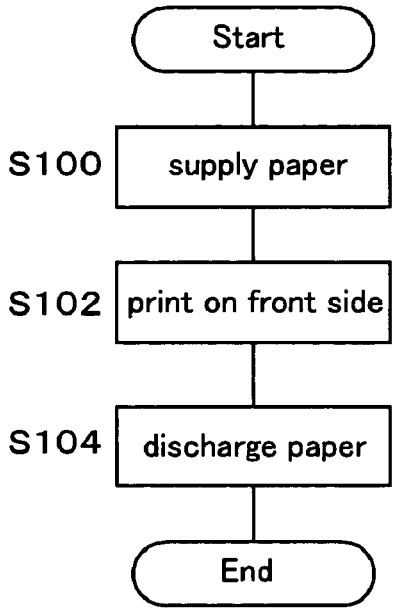
FIG. 11 is a flowchart illustrating an example of an operation procedure for one-side printing.

FIG. 11 is a flowchart illustrating an operation procedure of the printer 10 in the one-side print mode. In this print mode, first, one sheet of paper P is supplied (S100). Then, the front side of the supplied paper P is printed on (S102). Next, the printed paper P is discharged (S104). This ends the printing process for the one-side print mode.

Figure 12:
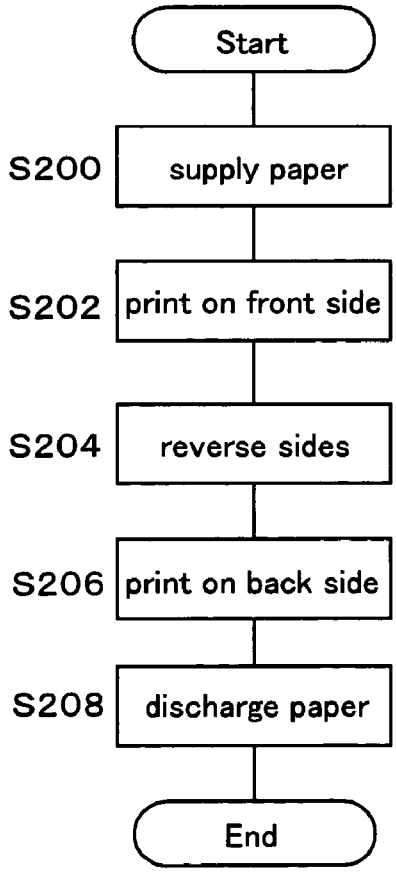
FIG. 12 is a flowchart illustrating an example of an operation procedure for duplex printing.

On the other hand, the duplex print mode allows printing to be carried out on both the front and back sides of the paper P. FIG. 12 is a flowchart illustrating an operation procedure of the printer 10 in the duplex print mode. In this print mode, first, one sheet of paper P is supplied (S200). Then, the front side of the supplied paper P is printed on (S202). Next, the paper P that has been printed on its front side is reversed by the paper reversing mechanism 90 (S204). In this way, preparation is made so that the back side of the paper P can also be printed on. Then, the back side of the paper P, which has been reversed, is printed on (S206). Finally, the paper P that has been printed on both sides is discharged (S208).

===Waiting Time===

The inkjet printer 10 according to the present embodiment provides a waiting time for sufficiently drying the paper before feeding the paper into the paper reversing path 92, because if the paper is fed into the paper reversing path 92 in a state where the ink is not completely dried during printing of the front side, the ink may adhere to the reversing path 92 and contaminate the path.

In the inkjet printer 10 according to the present embodiment, the drying and waiting time is set according to: the amount of ink ejected from the print head 68 onto the paper P; and the elapsed-time from when the ink was ejected from the print head 68. More specifically, the larger the amount of the ejected ink is, the longer the drying and waiting time is set. Further, the longer the elapsed-time from when the ink was ejected is, the shorter the waiting time is set.

<Ink Ejection Amount>

The amount of ink ejected (or, "ink ejection amount") can be measured from the amount of ink ejected by the print head 68 per droplet (i.e., per one ejection action) and the number of times the ink is ejected. The amount of ink ejected per droplet differs according to the size of the dot to be formed. FIG. 13 shows an example of a relationship between the size of the dot to be formed and the amount of ink ejected when that dot is formed. In this example, three levels in sizes, i.e., "small dot", "medium dot", and "large dot", are set as the sizes of the dots to be formed. The amount of ink ejected differs according to the size of the dot to be formed; the amount is "15 pl" for a "small dot", the amount is "25 pl" for a "medium dot", and the amount is "35 pl" for a "large dot". Information about the relationship between the size of the dot to be formed and the amount of ink ejected is, for example, stored in advance in an appropriate storing section, such as a memory, of the printer, or obtained from an external device such as the host computer 140.

The number of times of ink ejections is counted based on the print data that is sent from the host computer 140. That is, if, for example, the print data is made up of the above-described 2-bit data designating the sizes of the dots, then the number of times of ink ejections for each size is counted by obtaining, from the 2-bit data, information about whether or not to form a dot and the size of the dot to be formed, to calculate the total ejection amount for each size and obtain the total ink ejection amount.

<Elapsed-time>

On the other hand, the elapsed-time from when the ink was ejected can be measured with a timer etc. If a timer is provided in the system controller 126, then that timer can be used. The method for measuring the time may involve dividing the printing area into several areas and measuring the elapsed-time for each divided area. For example, there are methods in which the paper P is divided into the upper section, the middle section, and the lower section and the elapsed-time is measured for each area (i.e., each section), or in which an area that is printed from when the print head 68 starts moving until it ends its movement is regarded as one unit and the elapsed-time is measured for each area (i.e., each unit). As a result of this time measurement, it is possible to obtain a waiting time reflecting the elapsed-time from when the ink was ejected.

Other than the above, the following method may be adopted as the method for setting the waiting time according to the elapsed-time from when the ink was ejected.

<Setting Example>

In this example, printing that is performed from when the print head 68 starts moving until it ends its movement is regarded as one unit (referred to also as "pass" below), the ink ejection amount for each unit is obtained, and the waiting time is set according to an accumulated value that is obtained based on those ink ejection amounts.

Figure 14:
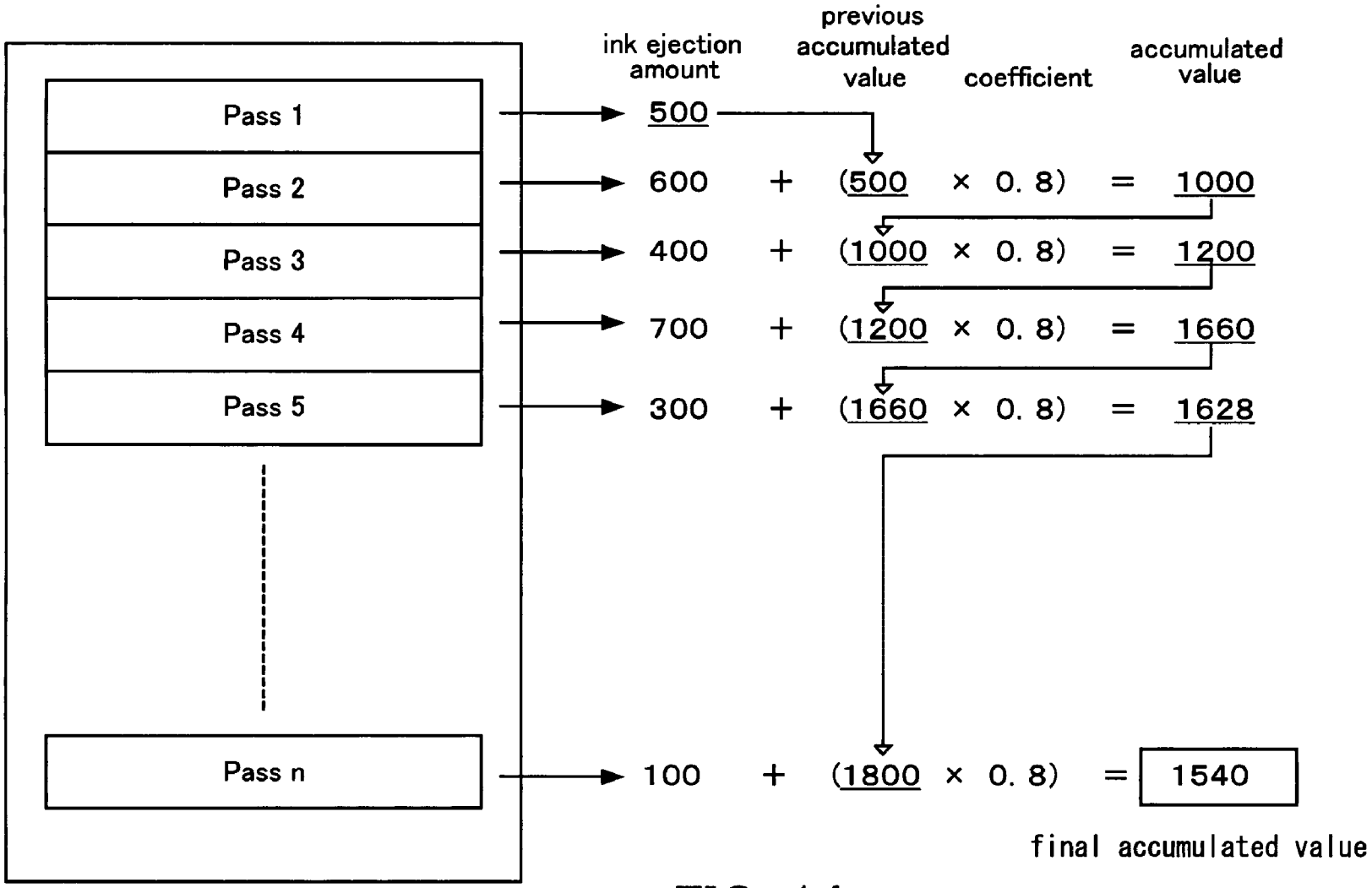
FIG. 14 is a diagram for illustrating an example of a method of setting a waiting time.

FIG. 14 shows an image of how the paper P is printed according to the units ("passes") described above. The print head 68 moves relatively with respect to the paper P and prints on the paper P during intervals between the carrying actions of the paper P performed by the carrying mechanism (the first carry drive roller 60 etc.). The carrying action of the paper P by the carrying mechanism and the printing action by the print head 68 are alternately repeated, thereby the paper P is gradually printed.

After the first movement (i.e., the first pass: Pass 1) of the print head 68, the amount of ink ejected in that movement is obtained. (It is assumed that the amount is "500".) Next, after the second movement (i.e., the second pass: Pass 2) of the print head 68, the amount of ink ejected in that movement is obtained. (It is assumed that the amount is "600".) At this time, a value obtained by multiplying a predetermined coefficient ("0.8" in this example) to the ink ejection amount "500" for the first movement is added to the ink ejection amount "600" for the second movement, thereby obtaining an accumulated value ("1000" in this example). Next, after the third movement (i.e., the third pass: Pass 3) of the print head 68, the amount of ink ejected in that movement is obtained, as described above. (It is assumed that the amount is "400".) Then, a value ("800"), which obtained by multiplying a predetermined coefficient ("0.8" in this example) to the accumulated value ("1000") of the ink ejection amounts up to the second movement of the print head 68, is added to the ink ejection amount obtained for the third movement, thereby obtaining an accumulated value ("1200", in this example). In this way, every time the print head 68 moves, an ink ejection amount for one movement is calculated, and a new accumulated value is obtained by adding, to the calculated ink ejection amount, a value obtained by multiplying a predetermined coefficient to the accumulated value up to a previous movement.

Accordingly, the waiting time is set based on the accumulated value ("1540" in this example) that is finally obtained at the end of printing. In this example, the larger the accumulated value is, the longer the waiting time is set, whereas the smaller the accumulated value is, the shorter the waiting time is set.

According to this calculation, a waiting time can be set easily, without placing much load on the system, according to the amount of ink ejected from the print head 68 and the elapsed-time from when the ink was ejected.

It should be noted that in the present embodiment, these calculating processes are executed by the system controller 126.

Further, in the present embodiment, the predetermined coefficient was set to "0.8". The present invention, however, is not limited to such a configuration, and the coefficient may be appropriately changed according to, for example, the printing speed of the print head 68.

<Other Aspects>

In the foregoing embodiment, the waiting time was set according to the ink ejection amount and the elapsed-time. The waiting time, however, may be set in consideration of the following aspects.

(1) Type of Ink

A difference in composition of ink, such as for pigment ink and dye ink, may be considered as the difference in the type of ink. Furthermore, the waiting time may be set according to, for example, the color of ink, such as black (K), cyan (C), magenta (M), and yellow (Y).

(2) Type of Medium

The waiting time may be set according to the type of medium, such as plain paper, matte paper, glossy paper, and film. In this case, it is possible to provide a determination member (determination means), such as a sensor, for determining the type of medium to be printed on, and to carry out settings based on information obtained with the sensor etc., or to carry out settings based on information about the type of medium to be printed on that has been sent from the host computer.

(3) Surrounding Temperature

The waiting time may be set according to the surrounding temperature. For example, if the surrounding temperature is high, then the waiting time may be set to be short because the ink will dry fast, whereas if the surrounding temperature is low, then the waiting time may be set to be long because it will take time for the ink to dry. In this case, a temperature sensor etc. may be provided in the printer body.

(4) Surrounding Humidity

The waiting time may be set according to the surrounding humidity. For example, if the surrounding humidity is high, then the waiting time may be set to be long because it will take time for the ink to dry, whereas if the surrounding humidity is low and the atmosphere is dry, then the waiting time may be set to be short because it will not take much time for the ink to dry. In this case, a humidity sensor etc. may be provided in the printer body.

(5) Flushing Action, Cleaning Action, etc.

When there occurs a situation, such as a cleaning action or flushing of the nozzles of the print head 68, in which the printing action is interrupted, then it will take extra time for printing. Therefore, the waiting time for ink drying may be set shorter in consideration of the extra time.

Settings regarding the aspects (1) through (5) described above can be made by: multiplying a predetermined coefficient to an ink ejection amount; adding or subtracting a predetermined numeric value to or from the ink ejection amount; changing the predetermined coefficient that is multiplied to the above-described accumulated value individually for each value; multiplying a predetermined coefficient to the accumulated value that is finally obtained at the end of printing; or adding or subtracting a predetermined numeric value to or from the finally-obtained accumulated value.

In the present embodiment, it is possible to set the waiting time according to the ink ejection amount and the elapsed-time from when the ink was ejected for cases in which the front side of the paper P is to be printed according to the duplex print mode. Therefore, it is possible to set an appropriate waiting time to the printer, shorten the waiting time, and achieve increase in printing speed.

===Configuration of Printing System etc.===

Next, a printing system according to the present invention will be described taking a system, which includes an inkjet printer as the printing apparatus, as an example.

Figure 15:
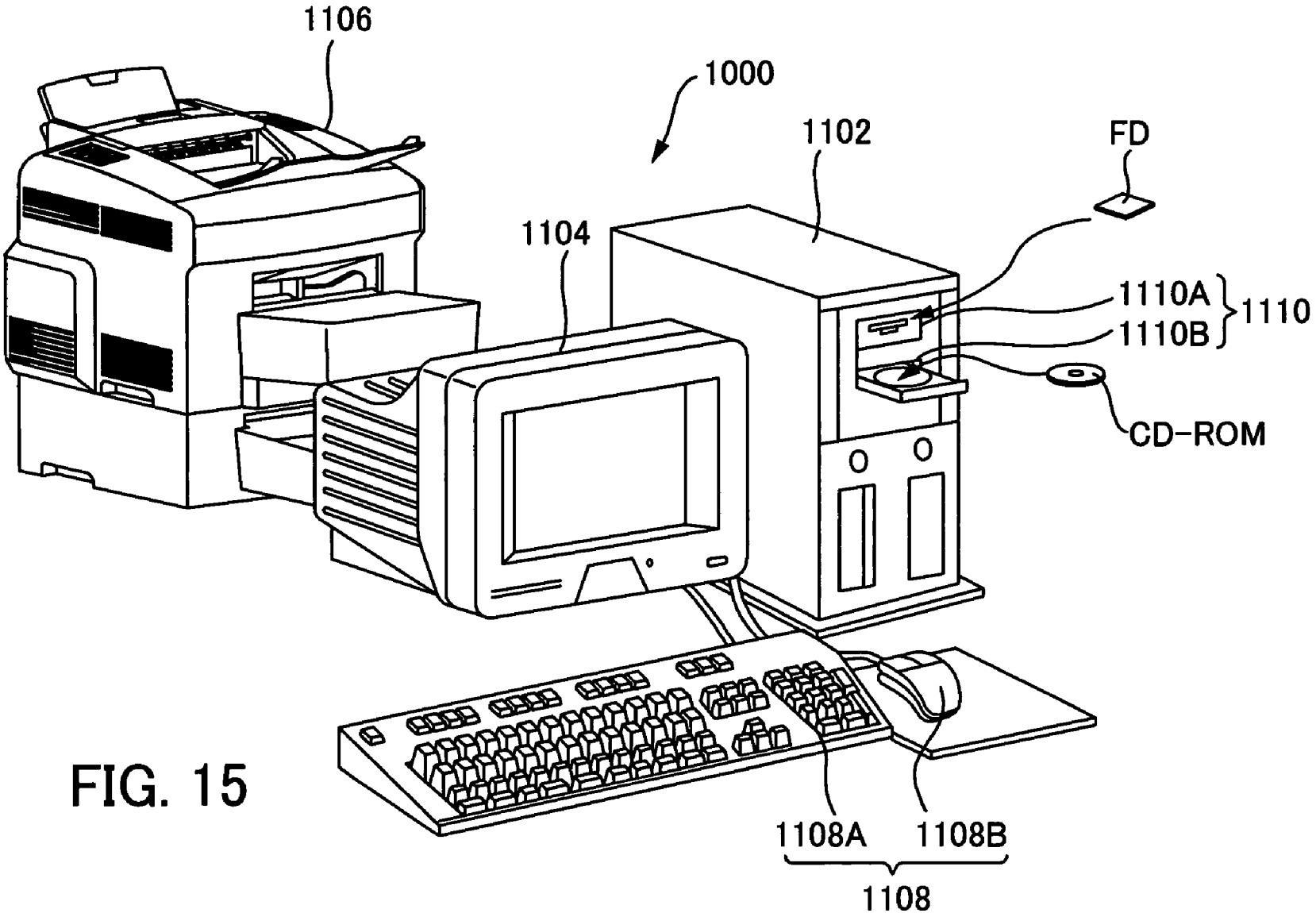
FIG. 15 is an external configuration diagram of a printing system.

FIG. 15 is an explanatory drawing showing an external structure of a printing system. The printing system 1000 comprises a computer unit 1102, a display device 1104, a printer 1106, an input device 1108, and a reading device 1110. In this embodiment, the computer unit 1102 is accommodated in a mini-tower type housing, but this is not a limitation. A CRT (cathode ray tube), a plasma display, or a liquid crystal display device, for example, is generally used as the display device 1104, but this is not a limitation. The printer described above is used as the printer 1106. In this embodiment, a keyboard 1108A and a mouse 1108B are used as the input device 1108, but this is not a limitation. In this embodiment, a flexible disk drive device 111A and a CD-ROM drive device 1110B are used as the reading device 1110, but the reading device is not limited to these, and it may also be other devices such as a MO (magneto optical) disk drive device and a DVD (digital versatile disk).

Figure 16:
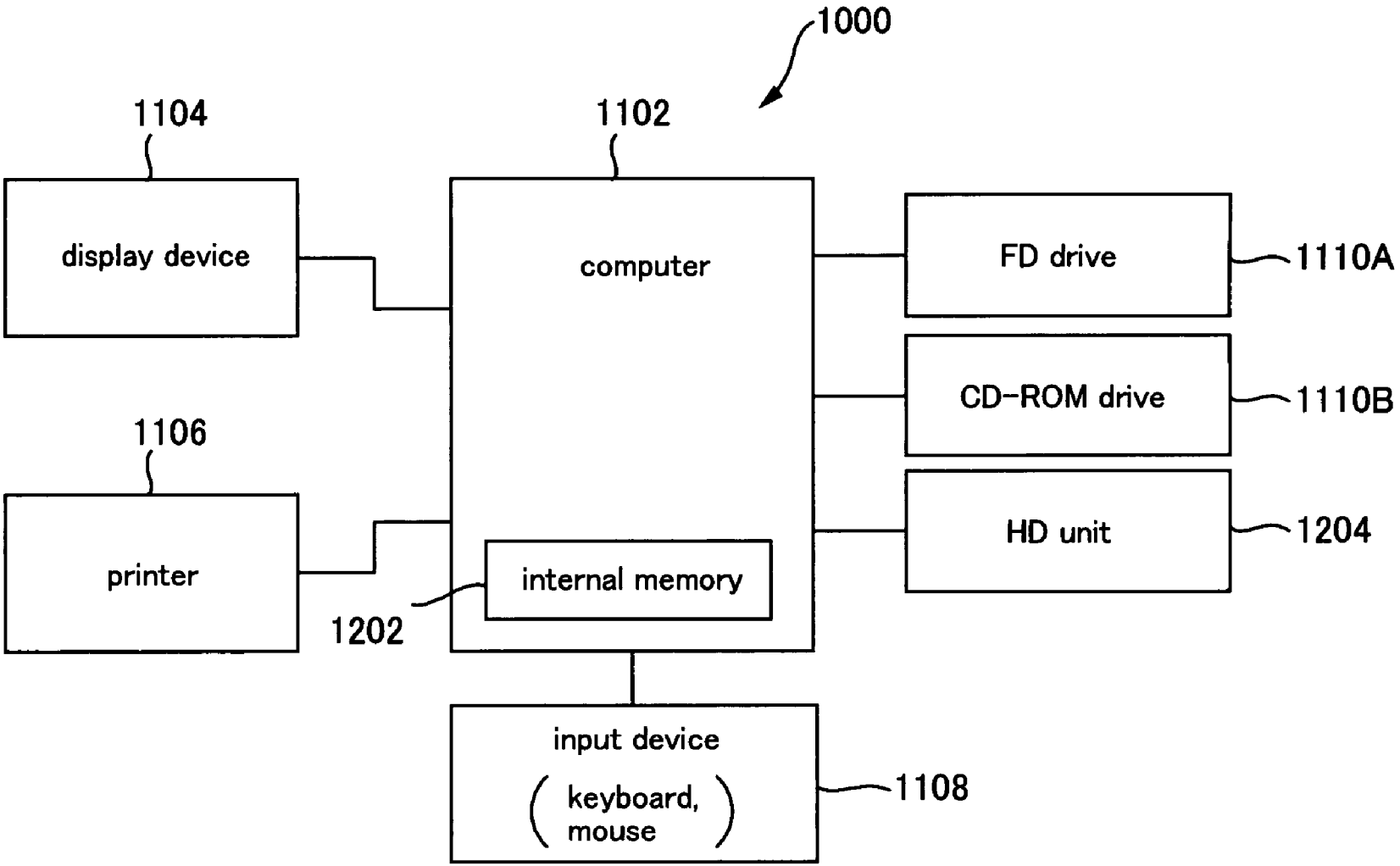
FIG. 16 is a block configuration diagram showing a configuration of the printing system.

FIG. 16 is a block diagram showing a configuration of the printing system shown in FIG. 15. Further provided are an internal memory 1202, such as a RAM inside the housing accommodating the computer unit 1102, and an external memory such as a hard disk drive unit 1204.

The computer program for controlling the actions of the printer described above can be downloaded to the computer unit 1102, which is connected to the printer 1106, via a communications line such as the Internet. The computer program may also be distributed by recording it on a computer-readable storage medium. Various storage media, such as flexible disks FD, CD-ROMs, DVD-ROMS, magneto-optical disks MO, hard disks, or memories, can be used as the storage medium. It should be noted that information stored in such a storage medium can be read by various types of reading devices 1110.

It should be noted that in the above description, an example in which the printing system is structured by connecting the printer 1106 to the computer unit 1102, the display device 1104, the input device 1108, and the reading device 1110 was described, but this is not a limitation. For example, the printing system can be made of the computer unit 1102 and the printer 1106, and the printing system does not have to comprise any one of the display device 1104, the input device 1108, or the reading device 1110. Further, for example, the printer 1106 can have some of the functions or mechanisms of the computer unit 1102, the display device 1104, the input device 1108, and the reading device 1110. For example, the printer 1106 may be configured so as to have an image processing section for carrying out image processing, a displaying section for carrying out various types of displays, and a recording media attach/detach section to and from which recording media storing image data captured by a digital camera or the like are inserted and taken out.

Furthermore, in the foregoing embodiment, the computer program for controlling the printer may be taken into the main memory 127, which is the storage medium of the controller 120. The actions of the printer in the foregoing embodiment may be achieved by the controller 120 executing the computer program stored in the main memory 127.

As an overall system, the printing system that is achieved in this way becomes superior to conventional systems.

===Other Embodiments===

A printing apparatus, such as a printer, according to the present invention was described above based on an embodiment thereof. The foregoing embodiment, however, has been given merely for facilitating understanding of the present invention, and is not to limit the present invention. It is without saying that the present invention may be altered and/or modified without departing from the gist thereof, and that the present invention includes its equivalents. Particularly, even the embodiments described below are included in the printing apparatus according to the present invention.

Further, some or all of the configurations achieved by hardware may be achieved by software, and conversely, some of the configurations achieved by software may be achieved by hardware.

Furthermore, other than print paper, the medium to be printed may be cloth, film, etc.

Furthermore, some of the processes performed by the printing apparatus may be performed by the host computer. It is also possible to provide a dedicated processing device between the printing apparatus and the host computer, and make this processing device perform some of the processes.

<About the Printing Head>

The printing head of the present invention is not limited to the inkjet printer described above, and it may be a printing apparatus, such as a bubble jet printer, that carries out printing according to other ink ejecting methods.

<About the Side-reversing Member>

The side-reversing member of the present invention is not limited to the side-reversing member described above, and it may be means for reversing the sides of a medium according to other methods.

<About the Media>

As regards the media, the paper P described above may be, for example, plain paper, matte paper, cut sheets, glossy paper, roll paper, photographic paper, or roll-type photographic paper, and other than paper, the media may be, for example, films such as OHP films and glossy films, cloth, or metal sheets. That is, any kind of medium may be used as long as it can be subjected to liquid ejection.

What is claimed is:

1. A printing apparatus comprising:

a printing head for ejecting ink to a medium to carry out printing thereon;

a side-reversing member for reversing the sides of said medium that is printed by said printing head; and a controller, wherein said controller is operative to set a waiting time for drying the ink ejected to said medium, before reversing said medium with said side-reversing member, according to:

an amount of ink ejected by said printing head, an elapsed-time from when the ink was ejected by the printing head, and wherein said controller is operative to:

divide a printing area into several areas and said amount of ink and said elapsed-time are measured for each divided printing area, calculate an amount of ink ejected to the divided area every time the printing head ejects ink to each divided area, and obtain a new accumulated value by adding the calculated amount of ink to a value obtained by multiplying a predetermined coefficient to an accumulated value previously obtained, and set the waiting time based on a final accumulated value that is obtained at an end of printing on the front side of said medium.

2. A printing apparatus according to claim 1, further comprising a carrying member for carrying said medium, wherein said printing head performs a printing action during intervals between carrying actions of said carrying member.

3. A printing apparatus according to claim 2, wherein said waiting time is set according to an amount of ink ejected by said printing head during an interval between the carrying actions of said carrying member, and an elapsed-time from the printing action performed by said printing head during said interval between said carrying actions.

4. A printing apparatus according to claim 1, wherein said amount of ink ejected by said printing head is calculated based on a number of times said ink is ejected by said printing head, and an amount of said ink ejected by said printing head per one ejection action.

5. A printing apparatus according to claim 1, wherein said waiting time differs according to a type of said ink ejected by said printing head.

6. A printing apparatus according to claim 1, wherein said waiting time differs according to a type of said medium that is printed by said printing head.

7. A printing apparatus according to claim 1, wherein said waiting time differs according to surrounding temperature.

8. A printing apparatus according to claim 1, wherein said waiting time differs according to surrounding humidity.

9. A printing apparatus comprising:

a printing head for ejecting ink to a medium to carry out printing thereon;

a side-reversing member for reversing the sides of said medium that is printed by said printing head;

a carrying member for carrying said medium; and a controller, wherein:

said printing head performs a printing action during intervals between carrying actions of said carrying member;

said controller is operative to set a waiting time for drying the ink ejected to said medium, before reversing said medium with said side-reversing member, according to:

an amount of ink ejected by said printing head during an interval between the carrying actions of said carrying member, and an elapsed-time from the printing action performed by said printing head during said interval between said carrying actions;

said controller calculates said amount of ink ejected by said printing head based on:

a number of times said ink is ejected by said printing head, and an amount of said ink ejected by said printing head per one ejection action; and wherein said controller is operative to:

divide a printing area into several areas and said amount of ink and said elapsed-time are measured for each divided printing area, calculate an amount of ink ejected to the divided area every time the printing head ejects ink to each divided area, and obtain a new accumulated value by adding the calculated amount of ink to a value obtained by multiplying a predetermined coefficient to an accumulated value previously obtained, and set the waiting time based on a final accumulated value that is obtained at an end of printing on the front side of said medium.

10. A computer-readable storage medium having recorded thereon a program executed by a printing apparatus tat includes a printing head for ejecting ink to a medium to carry out printing thereon, and a side-reversing member for reversing the sides of said medium that is printed by said printing head, said program achieving the step of:

setting a waiting time for drying, before reversing said medium with said side-reversing member, the ink ejected to said medium according to:

an amount of ink ejected by said printing head, and an elapsed-time from when the ink was ejected by the printing head, wherein:

a printing area is divided into several areas and said amount of ink and said elapsed-time are measured for each divided printing area, every time the printing head ejects ink to each divided area, an amount of ink ejected to the divided area is calculated, and a new accumulated value is obtained by adding the calculated amount of ink to a value obtained by multiplying a predetermined coefficient to an accumulated value previously obtained, and the waiting time is set based on a final accumulated value tat is obtained at an end of printing on the front side of said medium.

11. A printing method comprising:

ejecting ink to a medium to carry out printing thereon;

waiting in order to dry the ink ejected to said medium, a waiting time set according to:

an amount of the ink ejected, and an elapsed-time from when the ink was ejected; and reversing the sides of said medium after waiting for said waiting time, wherein:

a printing area is divided into several areas and said amount of ink and said elapsed-time are measured for each divided printing area, every time a printing head ejects ink to each divided area, an amount of ink ejected to the divided area is calculated, and a new accumulated value is obtained by adding the calculated amount of ink to a value obtained by multiplying a predetermined coefficient to an accumulated value previously obtained, and the waiting time is set based on a final accumulated value that is obtained at an end of printing on the front side of said medium.

12. A printing system comprising:

a computer; and a printing apparatus that is connectable to said computer and tat comprises:

a printing head for ejecting ink to a medium to carry out printing thereon, a side-reversing member for reversing the sides of said medium that is printed by said printing head, and a controller, wherein said controller is operative to set a waiting time for drying the ink ejected to said medium, before reversing said medium with said side-reversing member, according to:

an amount of ink ejected by said printing head, and an elapsed-time from when the ink was ejected by the printing head, and wherein said controller is operative to:

divide a printing area into several areas and said amount of ink and said elapsed-time are measured for each divided printing area, calculate an amount of ink ejected to the divided area every time the printing head ejects ink to each divided area, and obtain a new accumulated value by adding the calculated amount of ink to a value obtained by multiplying a predetermined coefficient to an accumulated value previously obtained, and set the waiting time based on a final accumulated value that is obtained at an end of printing on the front side of said medium.

* * * * *